United States Patent [19]

Lagus et al.

[11] 4,442,895

[45] Apr. 17, 1984

[54] METHOD OF HYDROFRACTURE IN UNDERGROUND FORMATIONS

[75] Inventors: Peter L. Lagus, Olivenhain; Edward W. Peterson, Del Mar, both of Calif.

[73] Assignee: S-Cubed, La Jolla, Calif.

[21] Appl. No.: 415,538

[22] Filed: Sep. 7, 1982

[51] Int. Cl.[3] ..... E21B 47/06; E21B 47/10; E21B 49/00

[52] U.S. Cl. ..... 166/250; 73/155; 166/308

[58] Field of Search ..... 166/250, 308, 191; 73/151, 155, 38

[56] References Cited

U.S. PATENT DOCUMENTS

| | | | |
|---|---|---|---|
| 2,429,577 | 10/1947 | French, Jr. | 250/260 |
| 2,446,588 | 8/1948 | Herzog et al. | 250/260 |
| 2,450,265 | 9/1948 | Wolf | 250/258 |
| 2,560,510 | 7/1951 | Hinson | 250/260 |
| 2,629,446 | 2/1953 | Freling et al. | 166/187 |
| 2,747,401 | 5/1956 | Doll | 73/151 |
| 3,035,440 | 5/1962 | Reed | 73/151 |
| 3,427,652 | 2/1969 | Seay | 166/250 |
| 3,439,740 | 4/1969 | Conover | 166/250 |
| 3,565,172 | 2/1971 | Cole et al. | 166/250 |
| 3,592,056 | 7/1971 | Bernaix et al. | 73/155 X |
| 3,602,308 | 8/1971 | Vincent | 166/308 X |
| 3,871,218 | 3/1975 | Louis | 73/155 |
| 3,876,003 | 4/1975 | Kisling | 166/250 |
| 4,196,619 | 4/1980 | Collins | 73/155 |
| 4,282,750 | 8/1981 | Prats et al. | 73/155 |
| 4,292,842 | 10/1981 | Hallmark | 73/155 |
| 4,353,249 | 10/1982 | Lagus et al. | 73/155 |
| 4,357,992 | 11/1982 | Sweeney | 166/250 |

*Primary Examiner*—Stephen J. Novosad

*Attorney, Agent, or Firm*—Fitch, Even, Tabin & Flannery

[57] ABSTRACT

A method is disclosed for initiating or causing fracture of an underground formation. An isolated interval, with an adjacent guard region at either or both ends is formed by a suitable packer assembly. Pressure and/or flow within the test interval is then increased to initiate fracture while conditions such as pressure and/or flow are monitored within the test interval and guard region or regions to detect fracture propagation relative to the borehole axis.

10 Claims, 4 Drawing Figures

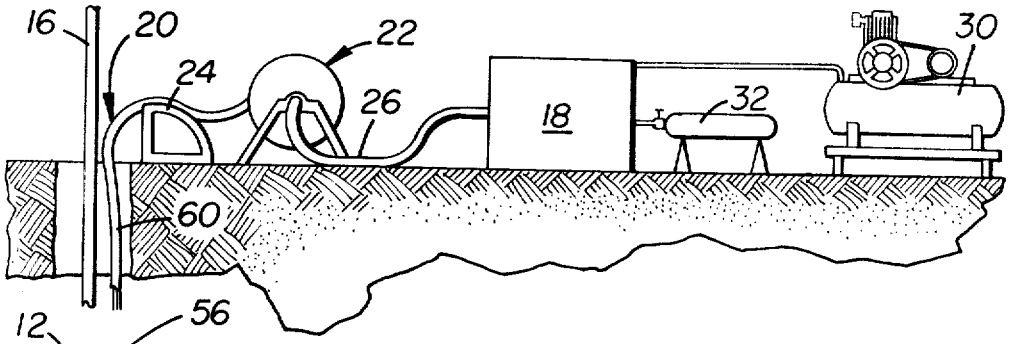
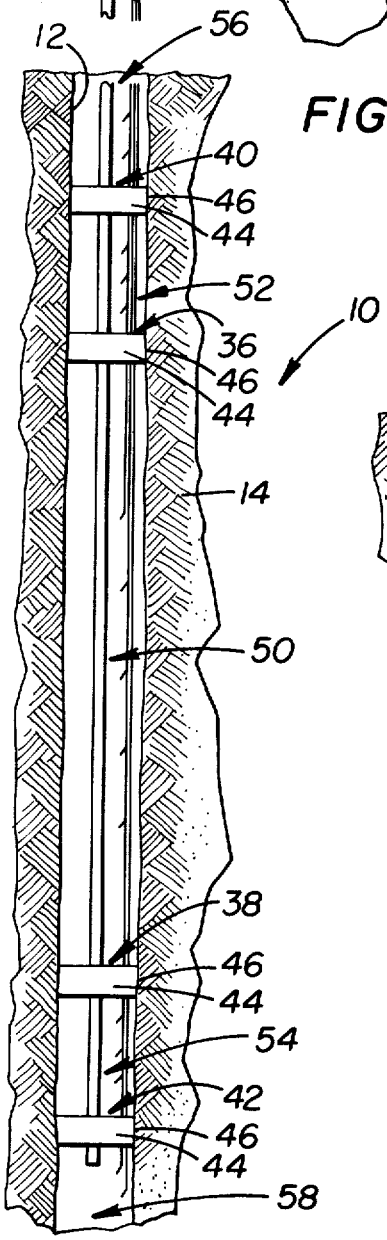
FIGURE 1
FIGURE 2
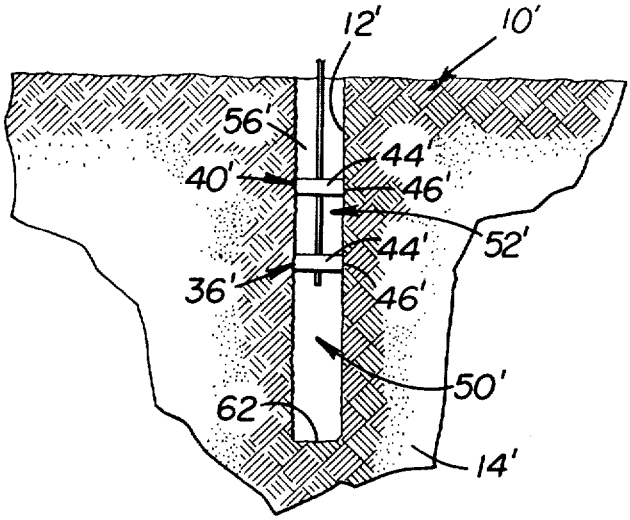

METHOD OF HYDROFRACTURE IN UNDERGROUND FORMATIONS

The present invention relates to a method for initiating fracture within an underground formation and more particularly to a method of hydrofracture employing a guarded packer assembly arranged in a borehole extending through an underground formation to be fractured.

Hydrofracture or hydraulic fracture techniques have commonly been employed in underground formations for a number of purposes. Initially, extensive fracture is commonly induced in gas or oil bearing formations in order to increase production. However, it is often necessary or desirable to be able to characterize fracture propagation relative to a borehole extending through the formation. For example, where the material to be recovered lies within a horizontal stratum of known dimensions, it may be desirable to initiate radial fracture relative to the axis of the borehole only within the selected production stratum. In the prior art, detection of the direction and/or extent of fracture propagation has not been possible, particularly during actual fracture of the formation. Rather, the prior art generally contemplated a first step of causing fracture within an underground formation followed by a second and separate step for detecting the extent and direction of propagation for the fracture.

Accordingly, there has been found to remain a need for a method of fracture permitting essentially simultaneous monitoring of fracture characteristics.

It is therefor an object of the invention to provide a method for causing hydrofracture in an underground formation about a borehole extending through the underground formation while essentially simultaneously detecting selected fracture characteristics, especially fracture propagation, direction and extent relative to the axis of the borehole.

The invention accomplishes this object by defining an isolated test interval and at least one adjacent guard region along the borehole, pressure being increased within the test interval for initiating fracture of the surrounding formation while simultaneously and separately monitoring selected conditions in the test interval and the adjacent guard region.

More particularly, the method of the invention may be carried out with the test interval being formed between a single packer and an end of the borehole, a single guard region being formed by a guard packer spaced apart from the primary packer. At the same time, the method may also be carried out within any selected segment of a borehole by defining a test interval along the borehole by two primary packers, separate guard packers being spaced apart from the primary packers to form guard regions at opposite ends of the test interval. In either event, the monitoring of selected conditions such as flow and/or pressure within the test interval and guard region or regions permits determination of fracture propagation direction relative to the axis of the borehole.

While the present invention is particularly concerned with detection of the extent of axial fracture propagation by monitoring conditions within the guard region during the fracture process itself, it is also possible to obtain information relating to the extent of fracture propagation, for example, by conducting flow tests before and after one or more fracture operations. An additional feature of the present invention is that both fracture initiation and flow testing operations can be performed without changing the configuration of the packer assembly.

Additional objects and advantages of the invention are made apparent in the following description having reference to the accompanying drawings.

In the drawings:

FIG. 1 is a generally schematic representation of one embodiment of a guarded straddle packer assembly suitable for practicing the method of the present invention.

FIG. 2 is a generally schematic representation of another embodiment of a guarded straddle packer assembly for practicing the method of the invention.

Figure 3:
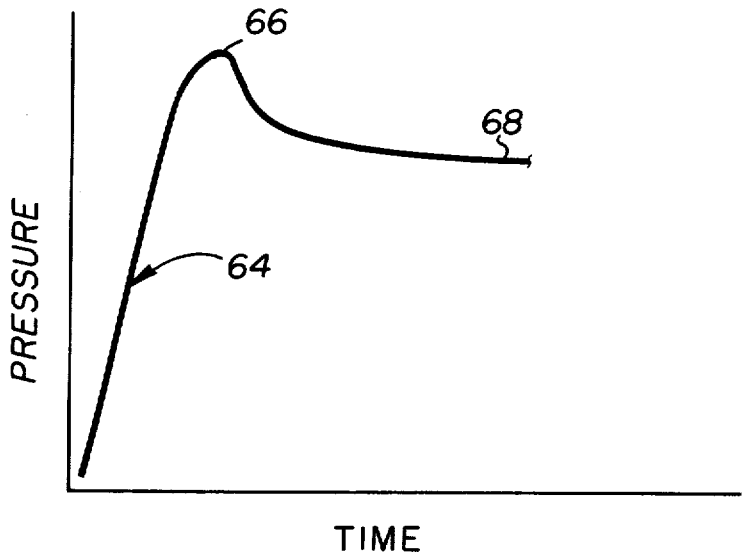
FIG. 3 is a representation of a typical pressure trace developed during practice of the method of the invention.

Referring now to the drawings and particularly to FIG. 1, the present invention contemplates a method of hydrofracture carried out in various underground formations. The method initially employs a guarded straddle packer assembly 10 arranged within a borehole 12 extending through an underground formation of interest, as generally indicated at 14. The method of the invention can be practiced in boreholes of any orientation such as vertical, horizontal or even slanted. Furthermore, hydrofracture may be carried out at any point along the length of a borehole as indicated in FIG. 1 or at an end of the borehole as is indicated in FIG. 2.

Figure 4:
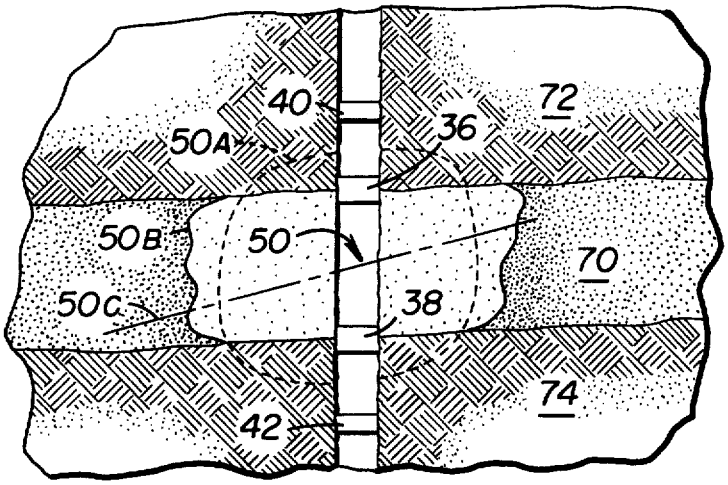
FIG. 4 is a cross-sectional representation of a guarded straddle packer assembly arranged within a borehole extending through an underground stratum while also illustrating three typical hydrofracture geometries which may be accomplished by the method of the present invention.

The method particularly contemplates the causing of hydrofracture by developing increased pressurization within an isolated interval formed by the guarded straddle packer assembly 10. Selected conditions such as flow and/or pressure are monitored within the isolated test interval and also within a guard region formed at either or both ends of the test interval, before, during and after fracture. Monitoring of these conditions within the test interval and the guard regions provides data concerning fracture characteristics within the underground formation. In particular, the pressure and/or flow conditions within the guard regions formed at one or both ends of the isolated test interval provide information as to the direction and extent of fluid flow and fracture propagation from the isolated test interval. Of greater importance to the present invention, the monitoring of flow conditions and particularly pressure within the guard regions formed at one or both ends of the isolated test interval provides a means for detecting the extent of axial fracture propagation of the underground formation. FIG. 4 illustrates a particular type of underground formation in which such information is particularly important. FIG. 4 also illustrates three modes or paths of fracture propagation possible for example in the present invention. Two of the fracture paths, indicated at 50A and 50B are essentially axial while that indicated at 50C is essentially radial.

A guarded straddle packer assembly of the type contemplated by the present invention is described in a co-pending application Ser. No. 202,076 entitled "Method and Apparatus for In Situ Determination of Permeability and Porosity" filed on Oct. 30, 1980 by the inventors of the present invention and now U.S. Pat. No. 4,353,249. That application sets forth further information concerning the measurement or inference of permeability from flow characteristics within a test interval defined along a borehole or the like. Accordingly, the disclosure of that reference is incorporated herein as though set out in its entirety.

Referring particularly to FIG. 1, the guarded straddle packer assembly 10 is supported in the borehole 12 by means of a steel tubing string 16. Various zones defined within the borehole 12, in a manner described in greater detail below, are placed in communication with suitable pressurization and monitoring components of the surface console 18 by means of a tube bundle 20 including, for example, electrical, pneumatic, hydraulic and/or mechanical signal transmitting means.

The guarded straddle packer assembly 10 may be raised and lowered in the borehole by means of the tubing string 16. As the guarded straddle packer assembly is raised and lowered in the borehole, the tube bundle 20 is also raised and lowered by means of a cable winch 22 while being trained over a slide tray 24 to facilitate its passage into and out of the borehole.

An extension 26 interconnects the tube bundle on the cable winch 22 with the console 18 which contains a number of pressurization and monitoring components as described in greater detail within the above noted reference. The guarded straddle packer assembly 10 is operable with various fluids, either liquid or gaseous. However, the method of the present invention particularly contemplates the use of a substantially non-compressible fluid, preferably a liquid, in order to best achieve fracture within a selected underground formation. However, the method allows use of gases and even steam without substantial changes in the mode of operation or apparatus.

In one embodiment a conventional compressor or pump 30 is interconnected with the control console 18. It may be employed to provide pressurization within one or more zones in the borehole. In addition, the compressor or pump 30 may also be employed to increase pressurization of non-compressible fluid within the borehole. An additional pressurized container 32 contains a pressurized gas such as nitrogen and may be used in order to permit closer regulation over fluid flow or pressurization of the borehole within the method of the present invention.

The guarded straddle packer assembly 10 includes four conventional expandable packers 36, 38, 40 and 42 mounted upon the tubing string 16. The spacing between the packers 36–42 may be adjusted in order to vary the dimensions of the intervals or regions formed between the packers.

The packers 36–42 are of generally conventional construction and are not otherwise a feature of the present invention. However, with the packers being arranged within the borehole in the manner illustrated in FIG. 1 and expanded into sealing engagement with the borehole, they define a series of intervals or regions along the length of the borehole. Initially, the primary packers 36 and 38 are spaced apart to define an isolated test interval 50 which is to be pressurized in accordance with the method of the present invention for achieving fracture in the surrounding formation. As noted above, the test interval 50 may be formed at any selected depth within the borehole and may be of any predetermined length by suitable adjustment of the packer assembly components.

Additional guard packers 40 and 42 are respectively spaced apart above and below the primary packers 36 and 38 to form upper and lower guard regions 52 and 54 above and below the test interval 50. It is again noted that the spacing between the primary and guard packers may also be adjusted in order to vary the lengths of the guard regions 52 and 54.

The surface console 18 is of generally complex construction in order to permit suitable communication with various regions of the packer assembly, particularly when it is in a location far beneath the surface. However, in accordance with the method of the invention, it is sufficient to understand that the console 18 and the tube bundle 20 include means for permitting pressurization of the test interval 50 and for simultaneously monitoring suitable flow conditions such as pressure within the primary interval 50 and also within the guard regions 52 and 54. The above noted reference is again pointed out in connection with operation of the surface console 18 and tube bundle 20.

Before describing the method of the invention, another packer assembly is illustrated in FIG. 2 as also being suitable for practicing the method of the invention. In FIG. 2, a similar borehole 12' is formed for receiving a modification of the guarded straddle packer assembly of FIG. 1 as generally indicated at 10'. Components of the straddle packer assembly 10' in FIG. 2 which conform with components already described in the embodiment of FIG. 1 are indentified by similar primed numerals.

The modified guarded straddle packer assembly 10' of FIG. 2 includes a single primary packer 36' and a single guard packer 40'. The isolated test interval 50' is formed beween the single primary packer 36' and an end of the borehole as indicated at 62. A single guard region 52' is formed between the primary packer 36' and the guard packer 40'.

Within the following description, the method of the present invention is described particularly with reference to a guarded straddle packer assembly of the type illustrated in FIG. 1. However, it will be apparent that the method could similarly be employed with the modified straddle packer assembly of FIG. 2.

The method of the present invention contemplates pressurization of the isolated test interval 50, preferably with a substantially incompressible fluid or liquid, the pressurized fluid or liquid being selected in accordance with conventional criteria for best achieving fracture within the particular surrounding formation. As noted above, the surface console 18 may be adapted to achieve pressurization within the test interval 50 while simultaneously monitoring conditions such as flow and/or pressure within the test interval 50 and also within the guard regions 52 and 54 at each end thereof.

As pressure is increased within the test interval 50, the guard regions 52 and 54 are left in an unpressurized or relatively low pressure condition so that any fluid leaking past the primary packers 36 or 38 tends to produce pressurization within the guard regions capable of being monitored by the surface console 18. This monitoring capability for the guarded straddle packer assembly is described in greater detail within the above noted reference.

At the same time, the method of the present invention contemplates pressurization of the test interval 50 to approximately the breakdown or fracture pressure of the surrounding formation. A typical pressure profile within the test interval 50 is illustrated by the trace 64 of FIG. 3. When pressure within the test interval 50 reaches the breakdown or fracture pressure of the surrounding formation, as indicated at 66 in FIG. 3, flow occurs into the resulting fracture emanating from the test interval 50. As a result, pressure within the test interval 50 decreases. Thereafter, fluid flow into the expanding fracture and surrounding formation tends to reach an equilibrium condition as generally indicated at 68.

The surface console 18 may be employed to sense the pressure history including the peak pressure developed within the test interval 50 which accordingly provides an indication of the breakdown or fracture pressure for the surrounding formation. At the same time, conditions such as pressure and/or flow continue to be monitored within the guard regions 52 and 54. If the fracture propagates radially outwardly from the test interval 50, as indicated at 50C, the fracture plane does not intersect the guard region. Hence, there will be no pressure increase within the guard regions attributable to the fracture propagation. However, if fracture initiated from the test interval 50 tends to propagate axially relative to the borehole as indicated at 50A, increased pressure attributable to fracture propagation will appear within the guard regions 52 and 54. Obviously, the development of such pressure within the guard regions would differ substantially from the pressurization ocurring therein because of system compliance or leakage past the primary packers. In the case of system compliance or packer leakage, pressure increase within the guard regions would tend to increase gradually during pressurization of the primary interval 50. However, if pressurization occurs within the guard regions because of axial fracture propagation, pressure increase would tend to be observed within the guard regions only after development of the pressure peak in the test interval 50 as illustrated in FIG. 3.

As noted above, such a method could similarly be performed with the modified packer assembly of FIG. 2. It will be apparent that conditions such as pressure and/or flow could similarly be monitored within the test interval 50' and the single guard region 52' in order to similarly detect axial fracture propagation relative to the borehole 12'

Yet another variation of the method of the present invention is illustrated in FIG. 4 which illustrates a stratum, for example of gas bearing sand, indicated at 70 lying between upper and lower strata 72 and 74 which may commonly comprise less permeable material such as shale. Within such an underground formation, it may be desirable to induce radial fracture, as illustrated at 50B, from the borehole outwardly into the gas bearing sand 70 without causing axial fracture extending into the upper and lower strata 72 and 74. Accordingly, the method of the present invention contemplates arrangement of the primary packers 36 and 38 adjacent the upper and lower extremities of the production stratum 70. With the primary packers in these positions, the test interval 50 would then be arranged in communication with the production stratum 70. Arrangement of the guard packers 40 and 42 in spaced apart relation from the primary packers would form the guard regions in communication with the upper and lower strata 72 and 74 at the extremities of the production stratum 70.

With a packer assembly such as that described in FIG. 1 being so arranged within the borehole of FIG. 4, pressurization of a fluid or liquid within the primary interval 50 would then tend to produce fracture within the gas bearing or production stratum 70. Leakage of the fluid past the primary packers could again be detected by monitoring conditions within the guard regions. Similarly, the axial propagation of fracture beyond the upper and lower extremities of the production stratum 70 could be readily detected by conditions such as pressure increase within the guard regions 52 and 54.

Other variations of the method of the present invention are believed obvious from the preceding description. Accordingly, the method of the present invention is defined only by the following appended claims.

What is claimed is:

1. In a method for causing hydrofracture in an underground formation having a borehole extending therethrough and/or thereinto, the steps comprising defining an isolated test interval along the borehole with at least one primary packer, defining at least one isolated guard region at one end of the test interval with a guard packer spaced apart from the one primary packer, filling the test interval with a selected fluid and increasing pressure within the test interval to a level for initiating fracture of the formation surrounding the borehole, and simultaneously and separately monitoring selected conditions such as pressure and/or flow in the test interval and guard region.

2. The method of claim 1 wherein an additional primary packer is spaced apart from the one primary packer to form the test interval, an additional guard packer being spaced apart from the additional primary packer to form an additional guard region opposite the one end of the test interval, conditions such as pressure and/or flow being simultaneously and separately monitored in the test interval and both guard regions.

3. The method of claim 2 wherein pressure is monitored within the test interval and within the two guard regions during fracture.

4. The method of claim 1 wherein the test interval is formed between the one primary packer and an end of the borehole.

5. The method of claim 1, 2 or 4 further comprising the step of performing flow tests before and after the formation is fractured in order to determine the extent of fracture.

6. The method of claim 1, 2 or 4 wherein the flow conditions are selected to permit determination of formation characteristics and possible leakage of fluid past the primary packers in an axial direction relative to the borehole.

7. The method of claim 1, 2 or 4 wherein the monitored conditions such as pressure and/or flow are used to detect axial fracture propagation relative to the borehole axis.

8. The method of claim 1 or 4 wherein pressure is monitored within the test interval and the one guard region during fracture.

9. The method of claim 1 wherein the test interval is defined in flow communication with a selected portion of the underground formation, the one isolated guard region being formed just outside the selected portion of the underground formation.

10. The method of claim 9 wherein primary packers are arranged adjacent opposite ends of the test interval, two guard packers being arranged in spaced apart relation relative to the primary packers for forming guard regions at each end of the primary interval just outside the selected portion of the underground formation.

* * * * *